US006618949B1

(12) United States Patent
Keener

(10) Patent No.: US 6,618,949 B1
(45) Date of Patent: Sep. 16, 2003

(54) SYSTEM AND METHOD FOR ADJUSTING SIGHTING PINS IN AN ARCHERY SIGHT AND DETERMINING THE VELOCITY OF AN ARROW

(76) Inventor: Shawn D. Keener, 2405 Homestead Pl., Garland, TX (US) 75044

( * ) Notice: Subject to any disclaimer, the term of this patent is extended or adjusted under 35 U.S.C. 154(b) by 0 days.

(21) Appl. No.: 10/118,712

(22) Filed: Apr. 9, 2002

(51) Int. Cl.[7] ..... F41G 1/467
(52) U.S. Cl. ..... 33/265; 124/87
(58) Field of Search ..... 33/265, 276, 277, 33/278, 506; 124/87

(56) References Cited

U.S. PATENT DOCUMENTS

| | | | | | |
|---|---|---|---|---|---|
| 2,461,122 | A | | 2/1949 | McQuitty | 33/46 |
| 3,118,674 | A | | 1/1964 | Curren | 273/102 |
| 4,153,999 | A | | 5/1979 | O'Steen | 33/265 |
| 4,244,586 | A | | 1/1981 | Gorrow | 273/409 |
| 4,263,719 | A | * | 4/1981 | Murdoch | 33/297 |
| 4,616,422 | A | * | 10/1986 | Gaddy | 33/265 |
| 4,915,088 | A | * | 4/1990 | Powers | 124/87 |
| 5,181,719 | A | | 1/1993 | Cleveland, III | 273/409 |
| 5,239,760 | A | | 8/1993 | Dixon et al. | 33/276 |
| D382,599 | S | | 8/1997 | Starrett | D21/5 |
| 5,802,726 | A | * | 9/1998 | Trosper et al. | 33/265 |
| 5,860,655 | A | | 1/1999 | Starrett | 273/408 |
| 5,893,356 | A | * | 4/1999 | Johns | 124/87 |
| 6,073,352 | A | * | 6/2000 | Zykan et al. | 33/265 |
| 6,134,793 | A | * | 10/2000 | Sauers | 33/265 |
| 6,213,470 | B1 | | 4/2001 | Miller | 273/409 |
| 6,418,633 | B1 | * | 7/2002 | Rager | 33/265 |

OTHER PUBLICATIONS

Bill Winke, "Understanding Arrow Energy And Efficiency", The Hunting Network, www.bowhunting.com, pp. 1–4, printed Mar. 4, 2002.

* cited by examiner

*Primary Examiner*—Diego Gutierrez
*Assistant Examiner*—Amy R. Cohen
(74) *Attorney, Agent, or Firm*—Michael L. Diaz

(57) ABSTRACT

A system and method for adjusting sighting pins in an archery sight for multiple target distances after the uppermost pin has been adjusted for a target distance such as 20 yards. An archery target is utilized with a horizontal reference indicator. Vertical offset distances from the reference indicator are determined for various target distances and arrow velocities, indicating where an arrow destined for the reference indicator on an imaginary target at a longer range such as 30 yards would strike the target at 20 yards. A vertical offset impact point is marked on the target at the offset distance from the reference indicator. A second pin corresponding to 30 yards is adjusted to visually overlie the reference indicator when the first pin is aimed at the offset impact point. By determining and marking offset distances corresponding to multiple target distances, multiple sighting pins can be adjusted in a similar manner.

14 Claims, 4 Drawing Sheets

SYSTEM AND METHOD FOR ADJUSTING SIGHTING PINS IN AN ARCHERY SIGHT AND DETERMINING THE VELOCITY OF AN ARROW

BACKGROUND OF THE INVENTION

1. Technical Field of the Invention

This invention relates to archery and bow hunting equipment. More particularly, and not by way of limitation, the present invention is directed to a system and method for sighting-in an-archery sight for various target distances and determining the velocity of an arrow shot from the bow.

2. Description of Related Art

It has long been known to provide archery bows with sights to improve the accuracy of arrows shot from the bow. Such sights are typically mounted on the riser of the bow, above the handle and resting location of the arrow. While various sight arrangements are known, it is common to provide a plurality of pins which extend laterally from the riser to a position above the arrow. The pins are vertically spaced with each pin acting as a sighting indicator for a particular target distance.

When an arrow is shot from the bow, its flight is substantially ballistic. Therefore, the angle of launch will determine the distance that the arrow travels. In use, the archer gauges the distance to the target and visually aligns the head of the appropriate pin on the desired impact point for the arrow. As such, the uppermost pin (corresponding to a low launch angle) is typically set to correspond to a 20-yard flight. The lowest pin (corresponding to a high launch angle) is set for a greater distance such as 60 yards, and the intermediate pins may be set for intervals such as every 10 yards therebetween.

Each of the pins must be individually set in the proper position for each of the desired distances. This is typically done in a time-consuming calibration process in which the archer shoots arrows at targets that have been laid out at the various distances, and through a trial and error approach, each pin is painstakingly adjusted to match the point of impact for the arrow at the pin's corresponding distance. This process is then repeated for each pin until all of the pins have been adjusted. As can be readily recognized, this is an extremely time-consuming process.

One proposed solution to the above-identified problem, is shown in Dixon et al. (U.S. Pat. No. 5,239,760). Dixon discloses an archery sight in which the pins are laterally mounted in a movable pin carriage and extend through slots in a fixed slide plate. The slots are linear and have increasing, yet proportionally constant spacing therebetween such that fore and aft movement of the pin carriage with respect to the slide plate causes the pins to move along the various slots and to expand or contract the distance between each pin. The archer then adjusts a first pin for a first desired distance using the existing trial and error method. The archer then places a target at a second distance and repeats the trial and error process for a second pin which is adjusted by moving the pin carriage forward or rearward along the slide plate. Dixon proposes that all of the other pins will then be in the proper position for the remaining predetermined distances due to the fixed proportional spacing provided by the slots in the slide plate.

The Dixon sight, and the process disclosed in Dixon for setting the pins, have several disadvantages. First, the archer must still use the time-consuming trial and error method to set two different pins for two different target distances. This creates a problem for the archer, not only because of the time involved in the process itself, but because it requires the archer to find a location suitable for shooting arrows at distances greater than 20 yards (the typical setting for the uppermost pin). This is a problem because indoor archery ranges are set up for shooting at 20 yards. For a longer distance, the archer has to find an open field, usually outside the city limits where he lives, where he can measure out the longer distance, set up a target, and shoot at the target so that he can properly align the second sight pin for the longer distance. Another problem with the Dixon sight is that it is not accurate enough for competition archery. The linear slots utilized with the slide plate are only an approximation of the sinusoidal function that defines the true ballistic flight of the arrow. Dixon admits that the linear slots are a compromise, but for competition archers, such a compromise is not acceptable.

In order to overcome the disadvantage of existing solutions, it would be advantageous to have a system and method for sighting-in an archery sight for various target distances that requires that only one pin be set with the trial and error method for 20 yards. In addition, such a system and method may be utilized to determine the velocity of an arrow shot from the bow. The present invention provides such a system and method.

SUMMARY OF THE INVENTION

In one aspect, the present invention is directed to a system for adjusting sighting pins for a plurality of target distances in an archery sight having a plurality of laterally-mounted, vertically-spaced sighting pins. A first sighting pin has been adjusted for a first target distance. The system includes an archery target with a horizontal reference indicator, and means for determining a vertical offset distance from the horizontal reference indicator. The offset distance indicates where an arrow destined for the horizontal reference indicator on an imaginary target at a second target distance would strike the target when mounted at the first target distance. The system also includes means for marking on the target, a vertical offset impact point at the vertical offset distance from the horizontal reference indicator. Finally, the system includes means for adjusting a second sighting pin corresponding to the second target distance to visually overlie the horizontal reference indicator when the first sighting pin is aimed at the vertical offset impact point. By determining vertical offset distances corresponding to a plurality of target distances, a plurality of sighting pins can be adjusted in a similar manner.

In another aspect, the present invention is directed to a method of adjusting sighting pins for a plurality of target distances in an archery sight mounted on a bow and including a plurality of laterally-mounted, vertically-spaced sighting pins. The method includes the steps of mounting an archery target with a horizontal reference indicator at a first target distance, and adjusting a first sighting pin for the first target distance, by iteratively shooting a series of arrows at the target and adjusting the first sighting pin until the first sighting pin visually overlies the point of impact of an arrow. When the velocity of an arrow shot from the bow is determined, the method determines a vertical offset distance from the horizontal reference indicator. The offset distance indicates where an arrow destined for the horizontal reference indicator on an imaginary target at a second target distance would strike the target when mounted at the first target distance. This is followed by marking on the target, a vertical offset impact point at the vertical offset distance from the horizontal reference indicator; and adjusting a second sighting pin corresponding to the second target distance to visually overlie the horizontal reference indicator when the first sighting pin is aimed at the vertical offset impact point. By determining vertical offset distances corresponding to a plurality of target distances, a plurality of sighting pins can be adjusted in a similar manner.

In yet another aspect, the present invention is directed to a method of determining a velocity of an arrow shot from a bow having an archery sight mounted thereon. The sight includes a plurality of laterally-mounted, vertically-spaced sighting pins corresponding to a plurality of target-distances. The method includes the steps of adjusting a first sighting pin for a first target distance by iteratively shooting a series of arrows at a target mounted at the first target distance and adjusting the first sighting pin until the first sighting pin visually overlies the point of impact of an arrow. This process is then repeated for a second pin and a second target distance. This is followed by shooting an arrow at a target mounted at the first target distance while aiming at a reference indicator on the target with the second sighting pin. A vertical offset distance on the target is then measured between the reference indicator and the point of impact of the arrow. This is followed by calculating the velocity of the arrow using the formula $V=\sqrt{[K\times D2\times(D2-D1)\div Y]}$, where V is the velocity of the arrow (in feet-per-second), K is a multiplication factor defined for each target range, D1 is the first target distance (in yards), D2 is the second target distance (in yards), and Y is the measured vertical offset distance on the target.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
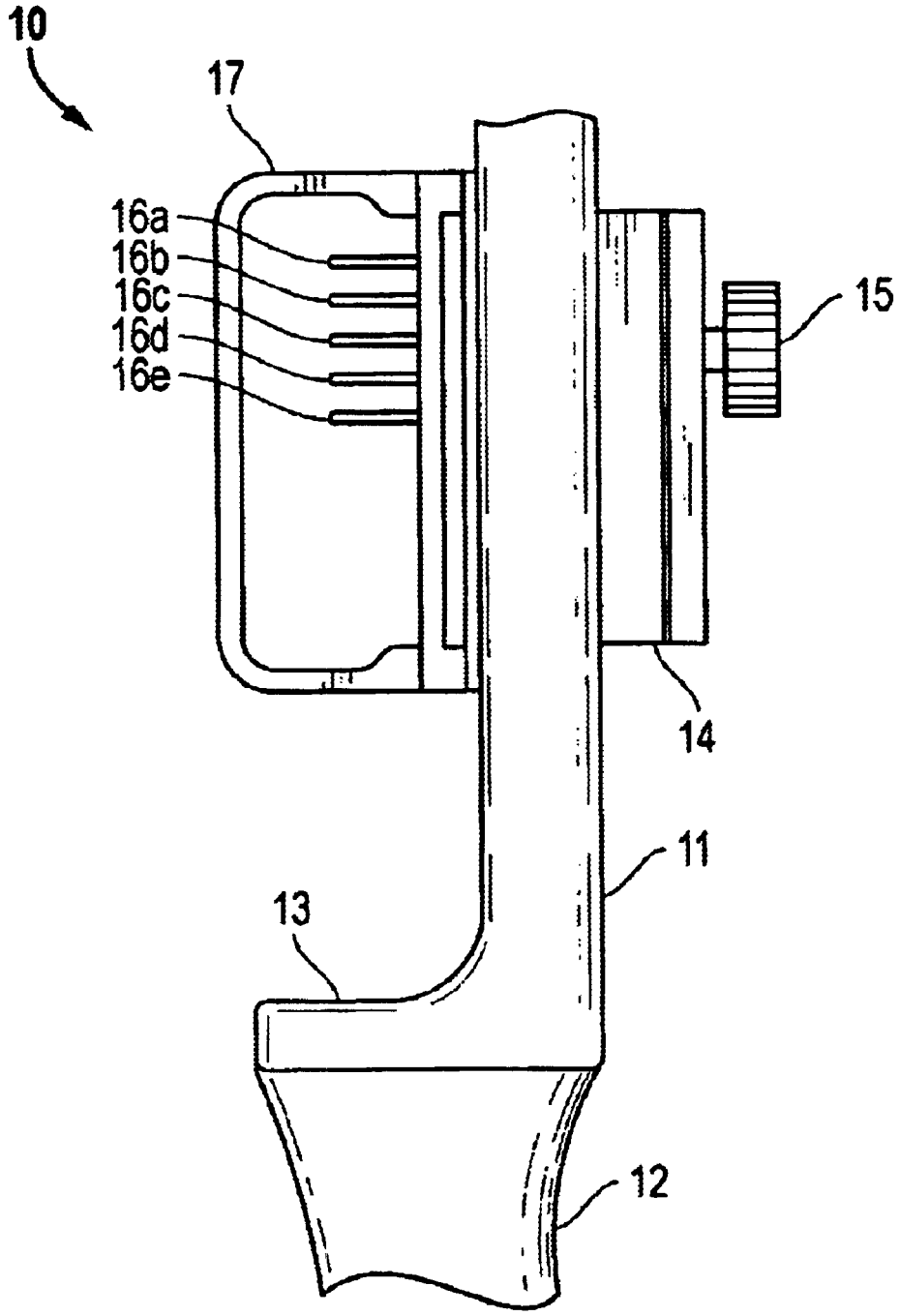
FIG. 1 is a rear elevation view of a typical archery pin sight suitable for use with the system and method of the present invention.

FIG. 1 is a rear elevation view of a typical archery pin sight 10 suitable for use with the system and method of the present invention. The pin sight is mounted on a riser portion 11 of a bow, just above a handle 12. The upper part of the handle forms a ledge 13 which may be used to support the arrow prior to shooting. The sight may be mounted to the riser portion with a bracket 14 that is tightened in place with an adjustment bolt 15. A plurality of adjustable sighting pins 16*a*–16*e* extend laterally into an opening formed by a pin guard 17.

In the embodiment illustrated in FIG. 1, the sight includes five sighting pins 16*a*–16*e*. In use, the archer gauges the distance to the target and visually aligns the head of the appropriate pin on the desired impact point for the arrow. As such, the uppermost pin 16*a* (corresponding to a low launch angle) may be set to correspond to a 20-yard flight. The lowest pin 16*e* (corresponding to a high launch angle) is set for a greater distance such as 60 yards. The intermediate pins 16*b*, 16*c*, and 16*d* may be set, for example, for 30, 40, and 50 yards, respectively.

Figure 2:
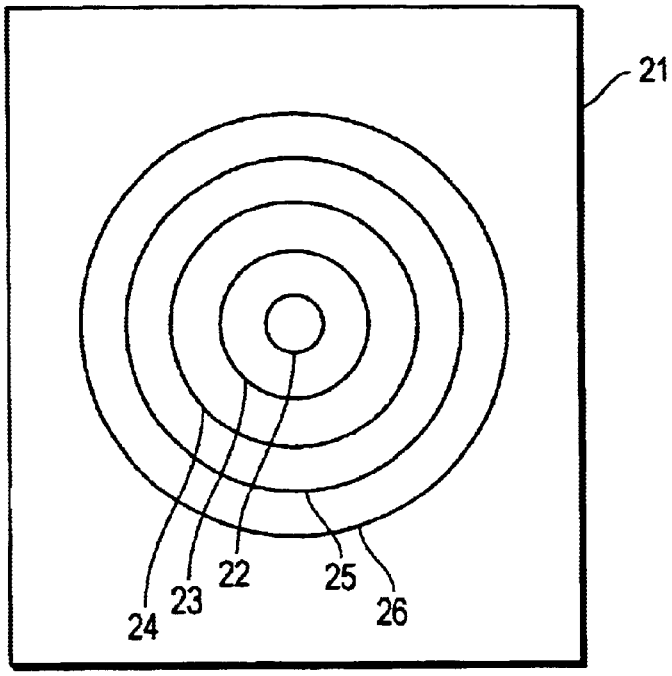
FIG. 2 (Prior Art)
FIG. 2 (Prior Art) is an illustrative drawing of a typical existing archery target.

FIG. 2 (Prior Art) is an illustrative drawing of a typical existing archery target 21. This conventional target configuration includes a circular bulls eye 22 and a plurality of concentric rings 23–26 surrounding the bulls eye. The rings are typically of a known radius so that the archer can determine his miss distance by the position of the arrow relative to the concentric rings.

Figure 3:
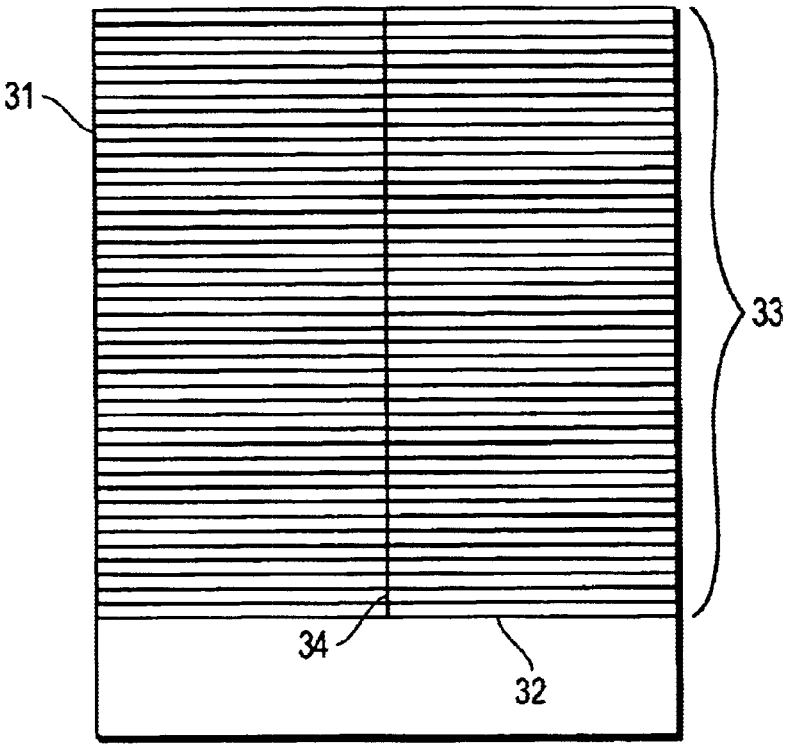
FIG. 3 is an illustrative drawing of the preferred embodiment of an archery target of the system of the present invention.

FIG. 3 is an illustrative drawing of the preferred embodiment of an archery target 31 of the system of the present invention. The target includes a horizontal reference line 32 extending across the target near the bottom. A plurality of horizontal lines 33 extend across the target above the reference line. In the preferred embodiment, the horizontal lines are spaced approximately every 0.2 inches. A central vertical line 34 extends upward from the reference line to the top of the target.

Figure 4:
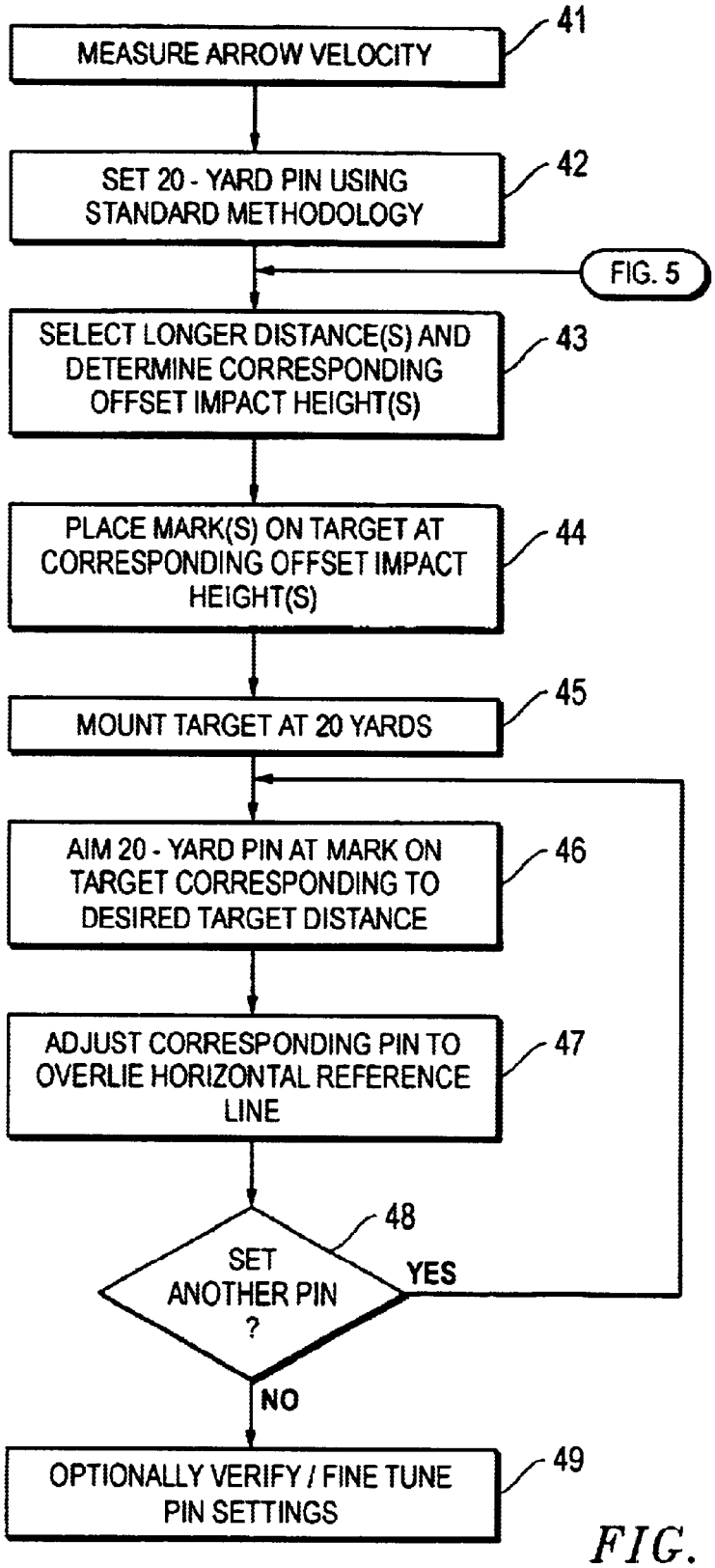
FIG. 4 is a flow chart illustrating the steps of the preferred embodiment of the method of setting the sight pins according to the teachings of the present invention.

FIG. 4 is a flow chart illustrating the steps of the preferred embodiment of the method of setting the sight pins according to the teachings of the present invention. The invention enables the archer to sight-in his bow for distances greater than 20 yards at an archery range having targets fixed at 20 yards. As is readily apparent, when an archer shoots an arrow intended for a target at, for example, 30 yards, but instead aims at a target at 20 yards, the arrow will strike the target at some height above the aim point. When the arrow velocity is known, the distance on the target from the aim point to the point of impact can be calculated using the following equation:

$$Y=[K\times D2\times(D2-D1)]\div V^2$$

where Y is the height (in inches) of the impact point above the aim point on the target, K is a multiplication factor defined for each target range, D1 is the actual distance (in yards) to the target for which the sight has been sighted-in (e.g., 20 yards), D2 is the longer distance (in yards) that is desired to be sighted-in (e.g., 30 yards), and V is the velocity (in feet-per-second) of the arrow. The multiplication factor (K) is equal to 1100 for 30 yards, 781 for 40 yards, and 582 for 50 yards.

In one embodiment of the method of the present invention the archer's arrow velocity is measured at step using standard equipment that is available at most archery ranges. At step 42, a pin such as the uppermost pin in the sight is set for the 20-yard distance using the standard methodology of shooting at the target and setting the pin to the impact point of the arrow. At step 43, a longer distance is selected, and the equation above is utilized to calculate a corresponding height above the aim point where the arrow will impact. The calculation may be performed manually, or may be performed by a pre-programmed calculator or computer. Alternatively, the calculations may be performed in advance and printed out in a set of tables that relate the offset impact distance to various target distances and arrow velocities. For example, for each desired target distance, tables may be printed for arrow velocities starting at 200 feet-per-second (fps), and continuing at an increment of every foot-per-second up to 400 fps.

At step 44, the archer measures the calculated distance above the reference line 32, and places a mark on the target 31 at that height. For example, if the archer desires to sight-in his bow for 30 yards, and his arrow velocity is 286 fps, he would place a mark on the target 4.032 inches above the reference line. Horizontal lines 33 assist the archer in placing the mark on the target. If the archer is sighting-in pins for several distances, he may place a mark on the target at each of the heights calculated for the desired distances. For example, if the actual target distance is 20 yards, the archer may solve the equation above to place marks on the target corresponding to target distances of 30, 40, and 50 yards.

At step 45, the archer mounts the target at the 20-yard distance. At step 46, the archer aims the uppermost pin (i.e., the 20-yard pin) at the mark he has made on the target corresponding to the desired target distance, such as 30 yards. At step 47, the archer adjusts the corresponding pin (i.e., the 30-yard pin) to overlie the horizontal reference line 32 on the target. At that point, the 30-yard pin is correctly adjusted for 30 yards.

At step 48, it is determined whether or not the archer desires to set another pin. If so, the process returns to step 46 where the archer aims the uppermost (20-yard) pin at the mark he has made on the target corresponding to the next desired target distance, such as 40 yards. At step 49, the archer adjusts the corresponding pin (i.e., the 40-yard pin) to overlie the horizontal reference line 32 on the target. At that point, the 40-yard pin is correctly adjusted. This process is then repeated for the 50-yard pin and the 60-yard pin, if present. In this manner, all of the pins may be properly adjusted without shooting another arrow. Thus, the archer is able to adjust all of the sight pins for any desired distance without leaving the 20-yard archery range, and while only having to shoot arrows to sight in the first pin.

Of course, after adjusting the pins, the archer may shoot arrows the target at step 49 to verify or fine tune the pin settings. When so doing, if the archer aims at the intersection of the horizontal reference line 32 and the central vertical line 34 with, for example the 30-yard pin, the arrow should strike the 20-yard target at the point where the archer has marked the target for the 30-yard height offset. Likewise, when aiming at the intersection of the horizontal reference line and the central vertical line with the 40-yard pin, the arrow should strike the 20-yard target at the point where the archer has marked the target for the 40-yard height offset, and so on for each pin.

Figure 5:
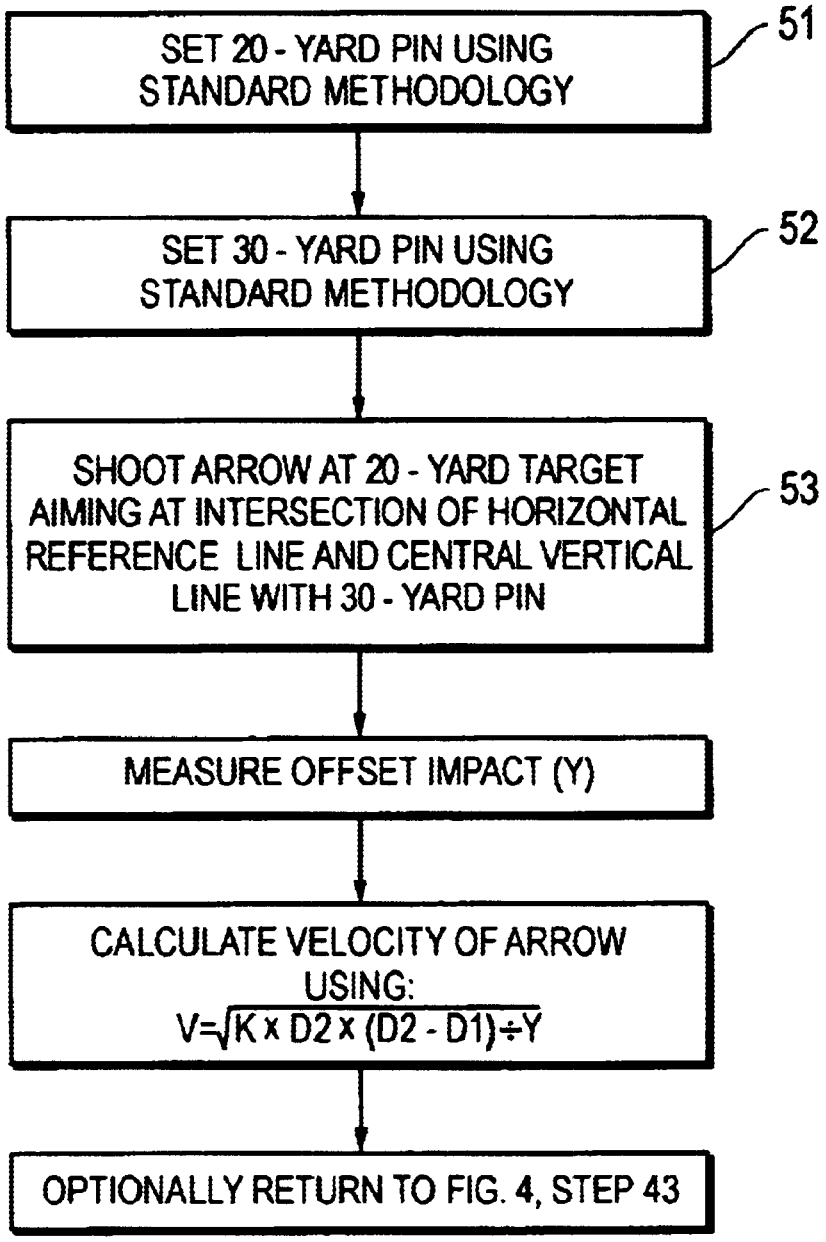
FIG. 5 is a flow chart illustrating the steps of the preferred embodiment of the method of determining the velocity of an arrow according to the teachings of the present invention.

FIG. 5 is a flow chart illustrating the steps of the preferred embodiment of the method of determining the velocity of an arrow according to the teachings of the present invention. At step 51, a pin such as the uppermost pin in the sight is set for the 20-yard distance using the standard methodology of shooting at the target and setting the pin to the impact point of the arrow. At step 52, the archer sets up a target at a longer distance such as 30 yards and once again uses the standard methodology of shooting at the target and setting the pin to the impact point of the arrow.

At step 53, the archer returns to the 20-yard target and shoots an arrow aiming at the intersection of the horizontal reference line 32 and the central vertical line 34 with the 30-yard pin. The arrow, of course, strikes the target at an offset height above the horizontal reference line. At step 54, the archer measures the offset impact height from the horizontal reference line to the impact point of the arrow. At step 55, the following equation is utilized to calculate the velocity of the arrow:

$$V=\sqrt{[K\times D2\times(D2-D1)\div Y]}$$

where, as before, V is the velocity (in feet-per-second) of the arrow, K is the multiplication factor defined for each target range above, D1 is the actual distance (in yards) to the target for which the sight has been sighted-in (e.g., 20 yards), D2 is the longer distance (in yards) that is desired to be sighted-in, and Y is the height (in inches) of the impact point above the aim point on the target. The calculation may be performed manually, or may be performed by a pre-programmed calculator or computer.

In one embodiment of the method of the present invention, after determining the arrow velocity in accordance with FIG. 5, the archer may then adjust the remaining pins using the methodology illustrated in FIG. 4. For example, if the archer has set the pins for 20 yards and 30 yards when determining the arrow velocity, he may return to FIG. 4 and proceed from step 43 to set the pins for 40, 50, and 60 yards.

It is thus believed that the operation and construction of the present invention will be apparent from the foregoing description. While the system and method shown and described has been characterized as being preferred, it will be readily apparent that various changes and modifications could be made therein without departing from the scope of the invention as defined in the following claims.

What is claimed is:

1. A system for adjusting sighting pins for a plurality of target distances in an archery sight having a plurality of laterally-mounted, vertically-spaced sighting pins, wherein a first sighting pin has been adjusted for a first target distance, said system comprising:

an archery target that includes a horizontal reference indicator;

means for determining a vertical offset distance from the horizontal reference indicator, said offset distance indicating where an arrow destined for the horizontal reference indicator on an imaginary target at a second target distance would strike the target when mounted at the first target distance;

means for identifying on the target, a vertical offset impact point at the vertical offset distance from the horizontal reference indicator; and means for adjusting a second sighting pin corresponding to the second target distance to visually overlie the horizontal reference indicator when the first sighting pin is aimed at the vertical offset impact point.

2. The system of claim 1 wherein the first sighting pin is an uppermost pin, and the first target distance is a shortest target distance for which a pin is to be set.

3. The system of claim 2 wherein the means for determining a vertical offset distance includes means for determining a plurality of vertical offset distances corresponding to a plurality of target distances greater than the shortest target distance.

4. The system of claim 3 wherein the means for marking a vertical offset impact point on the target includes means for marking a plurality of vertical offset, impact points on the target, each of the vertical offset impact points corresponding to a different one of the plurality of target distances.

5. The system of claim 3 wherein the means for adjusting the second sighting pin includes means for sequentially adjusting the plurality of sighting pins corresponding to the plurality of target distances to visually overlie the horizontal reference indicator when the first sighting pin is aimed at the vertical offset impact point corresponding to each target distance.

6. A method of adjusting sighting pins for a plurality of target distances in an archery sight mounted on a bow, said sight having a plurality of laterally-mounted, vertically-spaced sighting pins, said method comprising the steps of:

mounting an archery target that includes a horizontal reference indicator at a first target distance;

adjusting a first sighting pin for the first target distance, by iteratively shooting a series of arrows at the target and adjusting the first sighting pin until the first sighting pin visually overlies the point of impact of an arrow;

determining a velocity of an arrow shot from the bow;

determining a vertical offset distance from the horizontal reference indicator, said offset distance indicating where an arrow destined for the horizontal reference indicator on an imaginary target at a second target distance would strike the target when mounted at the first target distance;

marking on the target, a vertical offset impact point at the vertical offset distance from the horizontal reference indicator; and adjusting a second sighting pin corresponding to the second target distance to visually overlie the horizontal reference indicator when the first sighting pin is aimed at the vertical offset impact point.

7. The method of claim 6 wherein the step of adjusting a first sighting pin for the first target distance includes adjusting an uppermost pin for a target distance that is a shortest target distance for which a pin is to be set.

8. The method of claim 7 wherein the step of determining a vertical offset distance includes determining a plurality of vertical offset distances corresponding to a plurality of target distances greater than the shortest target distance.

9. The method of claim 8 wherein the step of marking a vertical offset impact point on the target includes marking a plurality of vertical offset impact points on the target, each of the vertical offset impact points corresponding to a different one of the plurality of target distances.

10. The method of claim 9 wherein the step of adjusting the second sighting spin includes sequentially adjusting the plurality of sighting pins corresponding to the plurality of target distances to visually overlie the horizontal reference indicator when the first sighting pin is aimed at the vertical offset impact point corresponding to each target distance.

11. The method of claim 6 wherein the step of determining a vertical offset distance includes determining a vertical offset distance using the formula $Y=[K\times D2\times(D2-D1)]\div V^2$, where:

Y is the vertical offset distance (in inches);

K is a multiplication factor defined for each target distance, wherein K is approximately equal to 1100 for 30 yards, 781 for 40 yards, and 582 for 50 yards;

D1 is the first target distance (in yards);

D2 is the second target distance (in yards); and

V is the velocity of the arrow (in feet-per-second).

12. The method of claim 6 wherein the step of determining the velocity of the arrow includes measuring the velocity with a chronograph.

13. A method of determining a velocity of an arrow shot from a bow having an archery sight mounted thereon, said sight having a plurality of laterally-mounted, vertically-spaced sighting pins corresponding to a plurality of target distances, said method comprising the steps of:

adjusting a first sighting pin for a first target distance by iteratively shooting a series of arrows at a target mounted at the first target distance and adjusting the first sighting pin until the first sighting pin visually overlies the point of impact of an arrow;

adjusting a second sighting pin for a second target distance by iteratively shooting a series of arrows at a target mounted at the second target distance and adjusting the second sighting pin until the second sighting pin visually overlies the point of impact of an arrow;

shooting an arrow at a target mounted at the first target distance while aiming at a reference indicator on the target with the second sighting pin;

measuring a vertical offset distance on the target between the reference indicator and the-point of impact of the arrow; and calculating the velocity of the arrow using the formula $V=\sqrt{[K\times D2\times(D2-D1)\div Y]}$, where:

V is the velocity of the arrow (in feet-per-second);

K is a multiplication factor defined for each target distance, wherein K is approximately equal to 1100 for 30 yards, 781 for 40 yards, and 582 for 50 yards;

D1 is the first target distance (in yards);

D2 is the second target distance (in yards); and

Y is the vertical offset distance (in inches).

14. A method of adjusting sighting pins for a plurality of target distances in an archery sight mounted on a bow, said sight having a plurality of laterally-mounted, vertically-spaced sighting pins, said method comprising the steps of:

mounting an archery target that includes a horizontal reference indicator at a first target distance;

determining a velocity of an arrow shot from the bow, said velocity determining step comprising the steps of:

adjusting a first sighting pin for the first target distance by iteratively shooting a series of arrows at the target mounted at the first target distance and adjusting the first sighting pin until the first sighting pin visually overlies the point of impact of an arrow;

adjusting a second sighting pin for a second target distance by iteratively shooting a series of arrows at a target mounted at the second target distance and adjusting the second sighting pin until the second sighting pin visually overlies the point of impact of an arrow;

shooting an arrow at the target mounted at the first target distance while aiming at the horizontal reference indicator on the target with the second sighting pin;

measuring a vertical offset distance on the target between the horizontal reference indicator and the point of impact of the arrow; and calculating the velocity of the arrow using the formula $V=\sqrt{[K\times D2\times(D2-D1)\div Y]}$, where:

V is the velocity of the arrow (in feet-per-second);

K is a multiplication factor defined for each target distance, wherein K is approximately equal to 1100 for 30 yards, 781 for 40 yards, and 582 for 50 yards;

D1 is the first target distance (in yards);

D2 is the second target distance (in yards); and

Y is the vertical offset distance (in inches);

determining a vertical offset distance from the horizontal reference indicator, said offset distance indicating where an arrow destined for the horizontal reference indicator on an imaginary target at a third target distance would strike the target mounted at the first target distance;

marking on the target, a vertical offset impact point at the vertical offset distance from the horizontal reference indicator; and adjusting a third sighting pin corresponding to the third target distance to visually overlie the horizontal reference indicator when the first sighting pin is aimed at the vertical offset impact point.

* * * * *